US005560148A

United States Patent [19]

Chang

[11] Patent Number: 5,560,148

[45] Date of Patent: Oct. 1, 1996

[54] DUAL AXLE LINKAGE MECHANISM FOR DOOR AND CASEMENT WINDOW

[76] Inventor: Chao Chang, No. 151-1, Nin-Ching St., Nuan-Nuan District, Keelung City, Taiwan

[21] Appl. No.: 297,424

[22] Filed: Aug. 26, 1994

[51] Int. Cl.[6] ..... E05D 15/50

[52] U.S. Cl. ..... 49/193; 49/382

[58] Field of Search ..... 49/193, 382; 16/229, 16/230, 231, 232, DIG. 23

[56] References Cited

U.S. PATENT DOCUMENTS

| | | | |
|---|---|---|---|
| 889,052 | 5/1908 | Scott | 49/193 X |
| 1,560,537 | 11/1925 | Cole | 49/193 X |
| 2,195,991 | 4/1940 | Lovett | 49/193 X |
| 3,403,473 | 10/1988 | Navarro | 49/193 |
| 5,357,652 | 10/1994 | Yamada | 49/193 X |
| 5,367,828 | 11/1994 | Hashemnia | 49/193 X |

*Primary Examiner*—Jerry Redman

*Attorney, Agent, or Firm*—Browdy and Neimark

[57] ABSTRACT

A dual axle linkage mechanism on a door and casement window includes a plurality of rotary axle units, a supporting device and a driving device. The rotary axle units are disposed on a corner of the door and window. Each rotary unit has a spindle, an upper guiding block, a lower guiding block, a holding device, a retaining device and a restoring spring. Each supporting device has a frame and a guiding channel. Each driving device has a sliding block, a sliding blade and a spring strip. The driving device can move a pair of spindles on one side up or down in the frame, such that either side which has a spindle disposed therein can serve as a rotary axle of the door and window.

3 Claims, 5 Drawing Sheets

DUAL AXLE LINKAGE MECHANISM FOR DOOR AND CASEMENT WINDOW

BACKGROUND OF THE INVENTION

Conventional door and casement window usually swing open or close by a fixed axle. The angle of swinging and visual span is restricted in a limited range, and result in some awkward situations occasionally. For example, in the event of emergency such as earthquake, fire or air raid, a not clearly marked door delay people's exit speed. Another example is a conventional casement window. It usually has a fixed axle and allows to swing open only in the middle, thus severely limits people's viewing scope. Because of this shortcoming, it is gradually replaced by aluminous frame window. However aluminous frame window also has drawbacks such as poor sealing, easy to take in draft and dust, poor noise deterrence, easily derailed, difficult to clean the glass, etc.

SUMMARY OF THE INVENTION

The present invention is a dual axle mechanism for door and casement window characterized by having two rotary axles which are symmetrically disposed at the two sides of the door or window, a supporting means composed of a frame and guiding channel, and a driving means composed of a sliding block, sliding blade and spring.

It is an object of the present mechanism for door and casement window to provide two rotary axles for each set door or casement window instead of one axle as traditional door or window does, thereby facilitating exit convenience during emergency as either side of the door or window can be opened. It further enhances design and architecture flexibility by providing more window opening options. The casement windows according to the invention are also more adaptable, more user-friendly and also enhances security.

In connection with the object set forth above, the present invention contemplates increasing the rotary axle of a door and casement window from traditional one set to two sets.

The present invention further contemplates a linkage mechanism to coordinate the interaction of these two axles, and to prevent the door or window from falling off. The linkage mechanism is composed of a rotary axle unit which includes a spindle, a pair of guiding blocks, a holding means, a retaining means, a restoring spring and a locking means, a supporting means which includes a frame and a guiding channel, and a driving means which includes a sliding block and sliding blade. The foregoing components and elements form together a top-down and right-left symmetrical dual rotary axle mechanism to achieve the object set forth above.

Additional objects and advantages of the present invention are made apparent in the following description having reference to the accompanying drawing.

DETAILED DESCRIPTION

Figure 1:
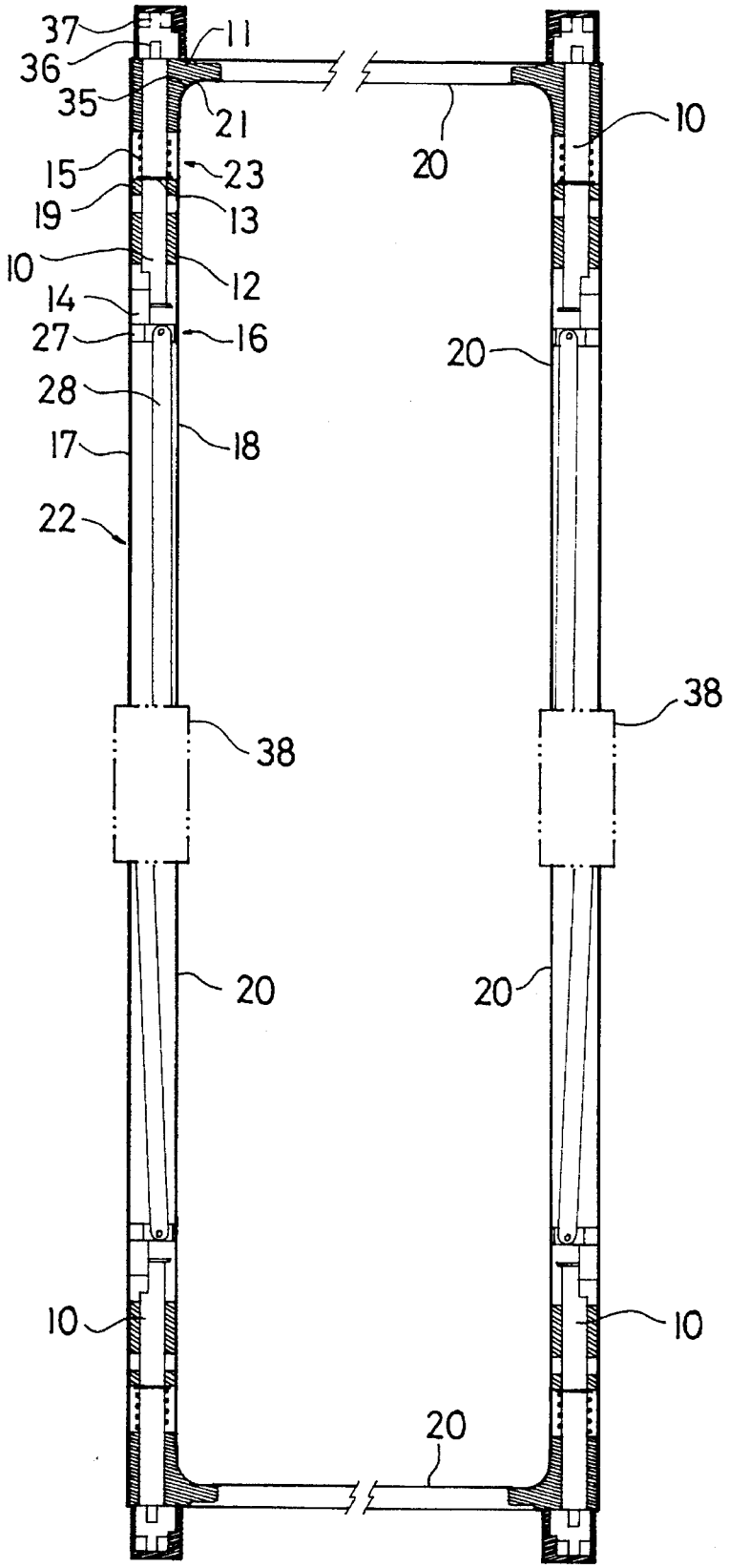
FIG. 1 is a plan view of the present invention.
Figure 2:
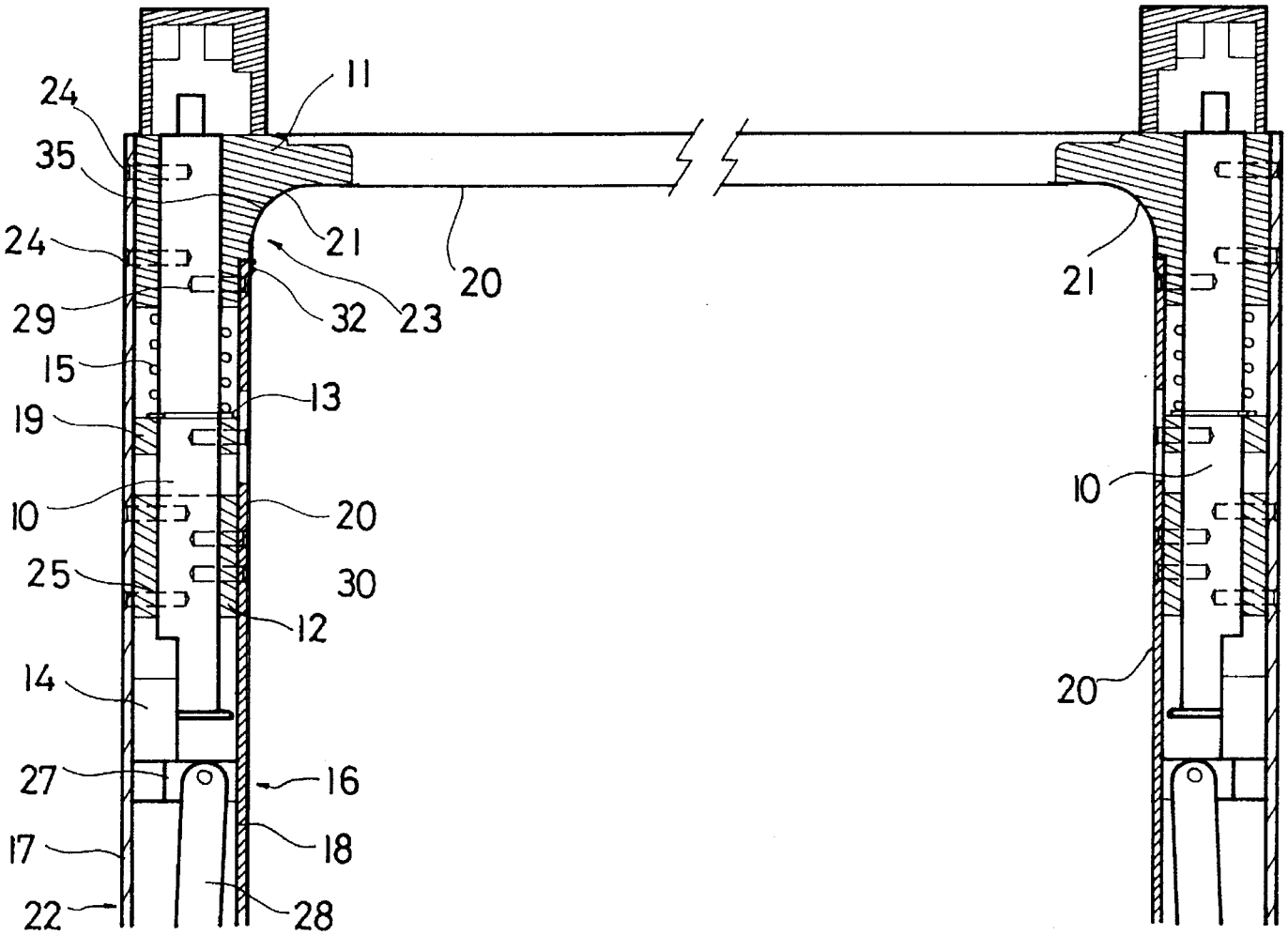
FIG. 2 is a fragmentary plan view of the present invention.
Figure 3:
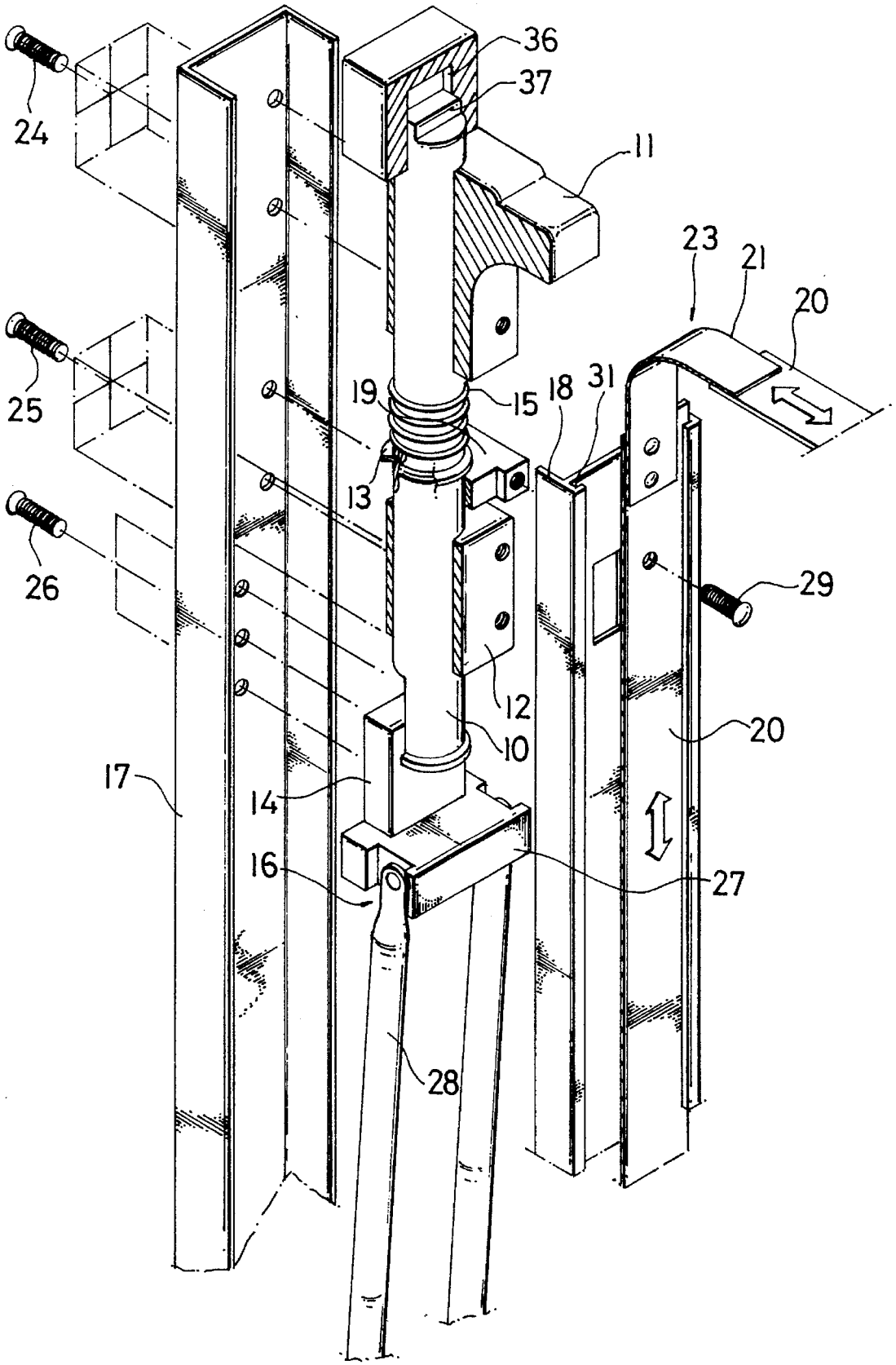
FIG. 3 is an exploded view of a rotary axle unit of the present invention.

Referring to FIG. 1, 2 and 3, the present invention includes two pairs of a rotary axle unit each composed of a spindle (10), an upper guiding block (11), a lower guiding block (12), a holding means (13), a retaining means (14), a restoring spring (15) and a locking means (16). The rotary axle units are disposed symmetrically up and down, left and right. A pairs of supporting means (22) each includes a frame (17) and a guiding channel (18). A pair of driving means (23) each includes a sliding block (19), a sliding blade (20) and a spring strip (21). A pair of rotary axle units, a supporting means and a driving means form a completed set of rotary axle assembly. A window or a casement door of the present invention has two sets of rotary axle assemblies disposed symmetrically on two lateral sides.

Spindle (10) runs through upper guiding block (11) and lower guiding block (12) and can be moved up or down thereon. Upper guiding block (11) is fixed on frame (17) by screw (24). Lower guiding block (12) is fixed on frame (17) by screw (25).

Spindle (10) also runs through a sliding block (19) which is disposed between upper guiding block (11) and lower guiding block (12). A holding means (13) is formed by having a E-shape snap washer disposed on an annular groove on spindle (10) locating above sliding block (19). A restoring spring (15) is disposed around spindle (10), above E-shape snap washer and between upper guiding block (11) and sliding block (19). When sliding block (19) is moved upward, holding means (13) also moves spindle (10) upward and compresses restoring spring (15). When sliding block (19) is moved downward, restoring spring (15) pushes E-shape washer of holding means (13) and thereby pushes spindle (10) downward.

A retaining means (14) is disposed below spindle (10) and is fixed on frame (17) by screw (26). Spindle (10) has a half circular crosssection at the bottom which can be inserted and engaged with the retaining means (14) when spindle (10) is moved downward. When spindle (10) is moved upward and rotated, its half circular bottom section would be disengaged with retaining means (14) and rests on the top of retaining mean (14).

A locking means (16) is disposed below retaining means (14) and includes a pushing block (27) which connects with a pair of linkage (28). Pushing block (27) has a protrudent top which can be moved to a lateral side of retaining means (14) and pushes spindle (10) upward for locking purpose.

A supporting means (22) includes a frame (17) and a guiding channel (18) which is fixed on upper guiding block (11) by screw (29) and is fixed on lower guiding block (12) by screw (30), thus forming a rugged supporting means with frame (17). Guiding channel (18) has two grooves (31) formed respectively on two lateral sides. A sliding blade (20) is disposed in groove (31). Sliding block (19) is fixed on sliding blade (20) by screw (32). Guiding channel (18) has an opening (32) on the section corresponding to the movement displacement of sliding block (19), thereby when sliding blade (20) moves up or down in groove (31), sliding block (19) is also moved up or down at the same time within the range of opening (32) on the guiding channel (18). Sliding blade (20) connects with each other via a spring strip (21) which runs through a fillet groove (35).

Figure 4B:
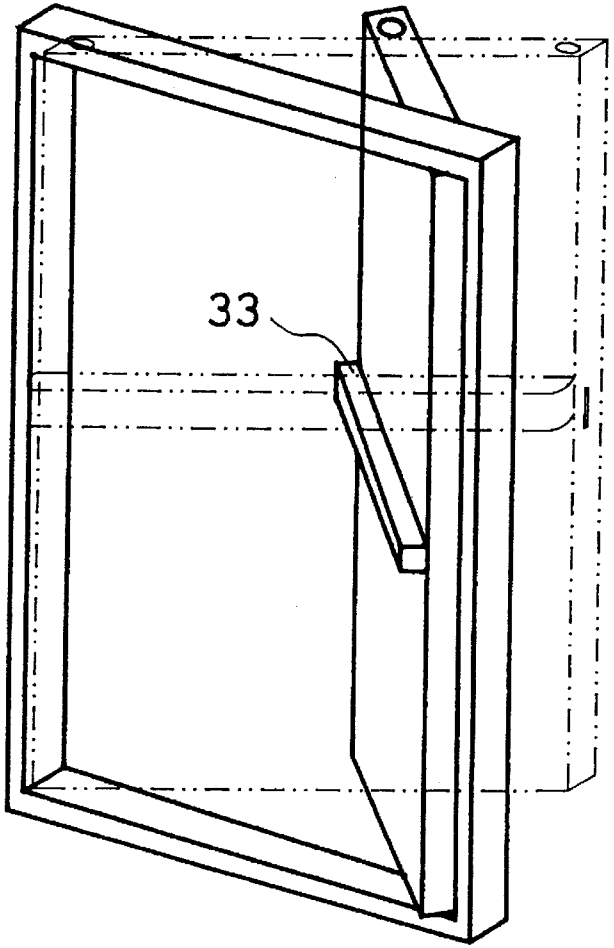
FIG. 4B is a pictorial view of the present invention being used as an emergency exit illustrating exit route.
Figure 4A:
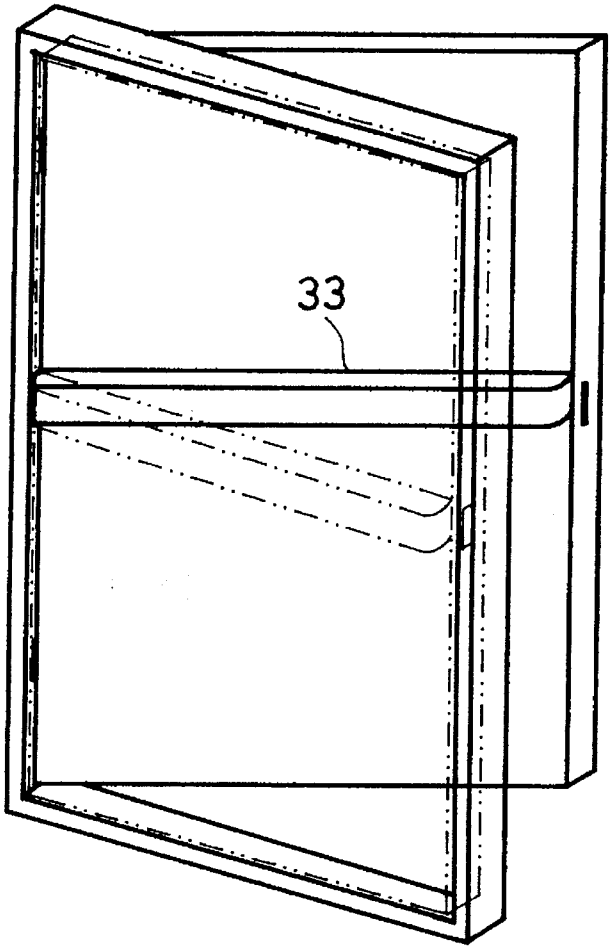
FIG. 4A is a pictorial view of the present invention being used as an emergency exit.

Referring to FIG. 4A and 4B, when a push bar (33) is pressed at one end (taking left side for example), actuator (38) (which adopts a conventional device available in a commonly used emergency door, not claimed in the present invention, and not described herein) moves sliding blade (20) toward center, thereby also moving holding means (13) toward center and consequently moving spindle (10) on the left hand side into the frame (17) of the door or window. Then spring strip (21) moves the transversely disposed sliding blade (20) to the left which also moves spring strip (21) on the right hand side to the left, then the spindle (10) on the right hand side is moved upward and has its top end disposed in the brake groove (36) of frame (17) on the right hand side. Such that the door or window takes the right hand spindle (10) as rotation axle and allows left hand side of the door or window to open for exit.

The top end of spindle (10) is formed in a rectangular end (37) which fits into rectangular brake groove (36) producing a brake result. Therefore spindle (10) remains stationary when the door or window swings open or close.

When the door or window swings open, retaining means (14) rotates at the same angle. Bottom end of spindle (10) rests on the top of retaining means (14), thereby prevents the right hand spindle (10) from moving downward, thus allowing the door or window to firmly engage with the frame (17) without falling out.

When the door or window swings close, bottom end of spindle (10) moves away from the top of retaining means (14) and rests on the top of pushing block (27). The end of spindle (10) at both left and right hand sides engages partially with brake groove (36), thus forming a locking status. Upper guiding block (11) and lower guiding block (12) give spindle (10) a sturdy support and make the present invention a strong and secure device for a door or a window.

Furthermore, when locking means (16) is activated (not shown in FIG. 1), linkage (28) and pushing block (27) move spindle (10) upward and making its top end (37) engage with brake groove (36), thus allowing the door or window to be firmly locked.

Referring to FIG. 5A to FIG. 5D for various application of the present invention.

Figure 5B:
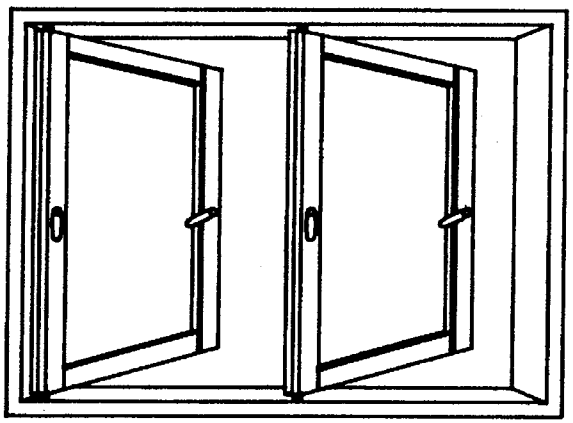
FIG. 5B is a pictorial view of the present invention being used in casement window with left side axle as rotary axle.
Figure 5D:
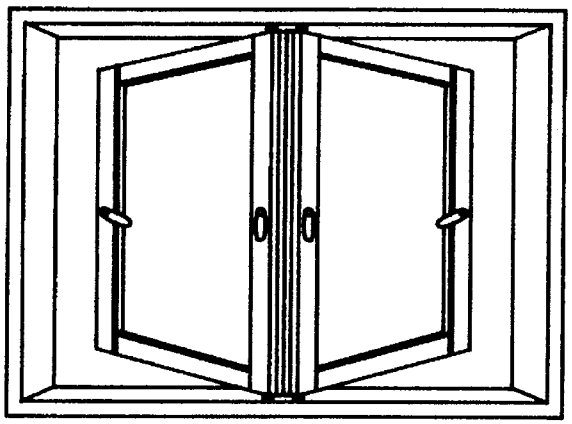
FIG. 5D is a pictorial view of the present invention being used in casement window with center axles as rotary axle.
Figure 5A:
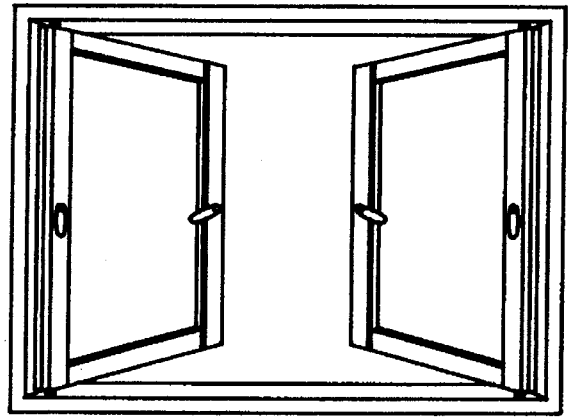
FIG. 5A is a pictorial view of the present invention being used in traditional casement window.
Figure 5C:
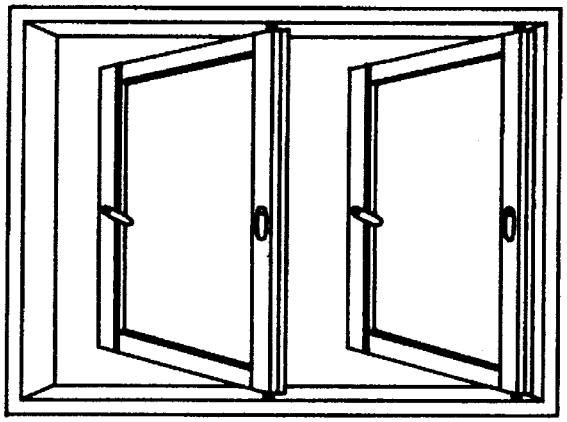
FIG. 5C is a pictorial view of the present invention being used in casement window with right side axles as rotary axle.

FIG. 5A illustrates traditional casement window which has restricted visual scope and is difficult to clean the outside window glass. FIG. 5B illustrates application which has both left side axles as rotary axle. FIG. 5C illustrates another application which has both right side axles as rotary axles. FIG. 5D illustrates a further application which has the center axles as rotary axles.

Above application examples show that the present invention can greatly increase the flexibility of casement window design and arrangement, and also make cleaning of window glass much easier and more effective than conventional casement window.

We claim:

1. A dual axle linkage mechanism on a door and casement window comprising:

a plurality of rotary axle units having a spindle which runs through an upper guiding block and a lower guiding block, a holding means, a retaining means, a restoring spring and a locking means, each unit of said rotary axle units disposed respectively at each corner of said door and window;

each of a pair of supporting means having a frame and a guiding channel respectively located on opposite sides of said door and window; and each of a pair of driving means having a sliding block, and a spring strip connecting a pair of sliding blades, said driving means respectively located between said opposite sides;

said spindle, said upper guiding block and said lower guiding block being disposed in said frame, said sliding block and said restoring spring being disposed around said spindle and between said upper guiding block and said lower guiding block, said holding means having an E-shape snap washer disposed on said spindle and between said sliding block and said restoring spring;

said sliding block connected with said sliding blades and being movable within said guiding channel, such that when said sliding blades on a first side of said opposite sides of said door and window are moved down, said holding means moves said spindle down into said frame, said sliding blades and said spring strip moves said spindle on a second side of said opposite sides of said door and window upward into engagement with a blade groove formed on top of said frame, said spindle being moved upward to become a rotary axle of said door and window.

2. A dual axle linkage mechanism of claim 1 wherein said retaining means is disposed under a bottom end of said spindle, said spindle further having a half circular cross section bottom end which can engage with said retaining means, such that when said door and window are swung open, said retaining means would also rotate and permit said spindle to rest on a top end of said retaining means and maintain a disengaged position with said retaining means, thus preventing said door and window from falling off said frame.

3. A dual axle linkage mechanism of claim 1 wherein said locking means has a pushing block which can push said spindle upward and make a top end of said spindle engage with said brake groove in said frame such that said door and window are locked.

* * * * *